US008052549B2

(12) United States Patent
Sykora

(10) Patent No.: US 8,052,549 B2
(45) Date of Patent: Nov. 8, 2011

(54) LACROSSE STICK WITH IMPROVED HEAD AND SHAFT CONNECTIONS

(76) Inventor: Elliot M Sykora, Wilmette, IL (US)

( * ) Notice: Subject to any disclaimer, the term of this patent is extended or adjusted under 35 U.S.C. 154(b) by 65 days.

(21) Appl. No.: 12/581,442

(22) Filed: Oct. 19, 2009

(65) Prior Publication Data

US 2011/0092322 A1 Apr. 21, 2011

(51) Int. Cl.
*A63B 59/02* (2006.01)
*A63B 65/12* (2006.01)

(52) U.S. Cl. ..... 473/513; D21/724

(58) Field of Classification Search ..... 473/505, 473/512, 513; D21/724
See application file for complete search history.

(56) References Cited

U.S. PATENT DOCUMENTS

| | | | | |
|---|---|---|---|---|
| 2,697,642 | A * | 12/1954 | Rudy | 403/410 |
| 4,940,243 | A | 7/1990 | Tucket et al. | |
| 5,865,694 | A | 2/1999 | Duong-Van | |
| 6,190,271 | B1 * | 2/2001 | Rappaport et al. | 473/451 |
| 6,916,259 | B2 | 7/2005 | Kohler et al. | |
| 6,949,037 | B2 | 9/2005 | Enos et al. | |
| 7,407,456 | B2 * | 8/2008 | Price et al. | 473/513 |
| 2004/0063522 | A1 | 4/2004 | Wolf | |
| 2004/0072638 | A1 * | 4/2004 | Enos et al. | 473/513 |
| 2005/0282666 | A1 | 12/2005 | Morrow | |
| 2006/0009318 | A1 | 1/2006 | Hayden et al. | |

* cited by examiner

*Primary Examiner* — Gene Kim
*Assistant Examiner* — M Chambers

(57) ABSTRACT

A lacrosse stick with an improved head and shaft connection is provided. The lacrosse stick comprises a head having a throat with a mounting hole therein, an elongated shaft attached to the head, the shaft having its own mounting hole, and a plug slidably disposed partly or entirely inside the hollow shaft to reinforce the shaft/head connection. The plug is inserted into the shaft such that the plug opening is aligned with the mounting holes on the head and shaft so that a screw or other attachment means can be inserted therethrough.

3 Claims, 2 Drawing Sheets

LACROSSE STICK WITH IMPROVED HEAD AND SHAFT CONNECTIONS

BACKGROUND

1. Field of the Invention

This invention relates to sporting equipment. More particularly, this invention relates to the improved attachment of a lacrosse stick head to a tubular lacrosse stick shaft.

2. Description of the Related Art

In an attempt to make lacrosse sticks stronger and lighter, manufacturers make the shaft out of hollow, thin walled, tubing. The tubing is made from a variety of alloys, but commonly from alloys of aluminum or titanium. The cross-sectional shape of the shaft is typically eight sided. The head typically is made of a polymer frame with a flexible mesh material tied to the frame with strings. The lacrosse stick is completed by fastening the head to the shaft.

Current methods of attaching the head to the shaft require a sheet metal screw to attach the head to the shaft with the screw gripping the shaft sidewall. Since the shaft sidewall is thin, the attachment is not strong enough in competitive play. The screw, and therefore the head, becomes loose and repair of the attachment is necessary. Any repair that can be done quickly is very unreliable.

Kohler and Sherman (U.S. Pat. No. 6,916,259) propose a head with a plug protruding from it to accept the screw for attachment. The head proposed by Kohler et al. solves the attachment problem, but it is not versatile. The head may not work well on a variety of shafts, and may not be available in the head design that some players prefer. Enos and Huling (U.S. Pat. No. 6,949,037) propose a quick release fastener for securing a lacrosse head to the shaft. Their method allows for quick repair, but the shaft and head need to be modified for their particular attachment method. This reduces the flexibility of using a variety of heads on a variety of shafts, and sacrifices attachment strength.

Thus it is an object of the present invention to provide a means of attaching a lacrosse stick head to a tubular lacrosse stick in a low cost manner.

Another object of the invention is to provide a means of attaching a lacrosse stick head to a tubular lacrosse stick that can be used with a variety of head shaft combinations.

Further and additional objects will appear from the description, accompanying drawings, and appended claims.

SUMMARY OF THE INVENTION

The present invention is a device for use in attaching a lacrosse stick head to a tubular lacrosse stick. The device is a plug having a body and a cross-sectional shape substantially the same as the hollow shaft. The plug body has an opening therein for receiving a screw or other attachment means, and is configured to be slidably received with the shaft. Typically, both the plug and shaft have a substantially octagonal cross sectional shape. The plug opening may be a threaded bore or pilot hole for receiving a machine screw.

The device may incorporate a magnet or ferrous material in its design to allow the device to be manipulated (moved) within the shaft with a magnet. The device may be used with a variety of head-shaft combinations.

THE DRAWINGS

DETAILED DESCRIPTION OF THE INVENTION

Figure 1A:
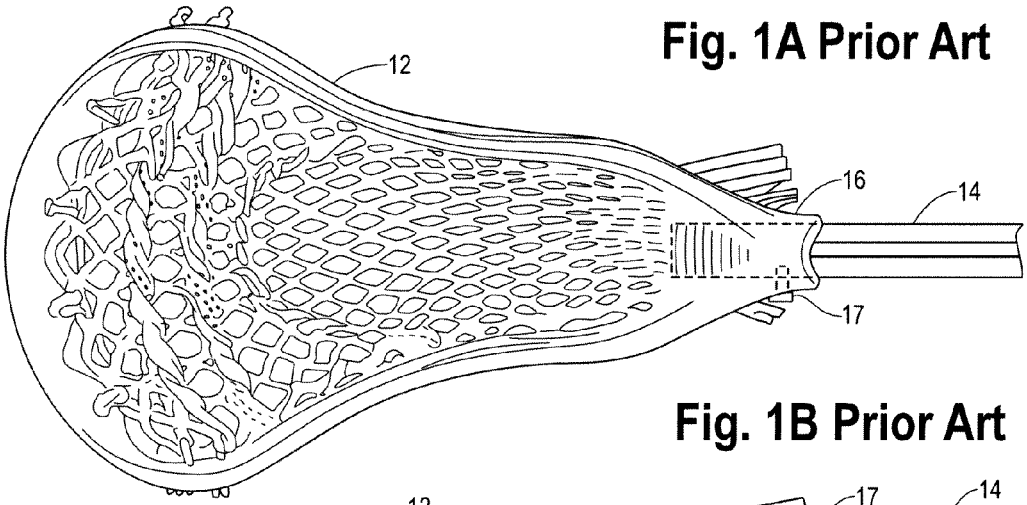
Fig. 1A Prior Art
FIG. 1A is a top view of a conventional lacrosse stick.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Figure 1B:
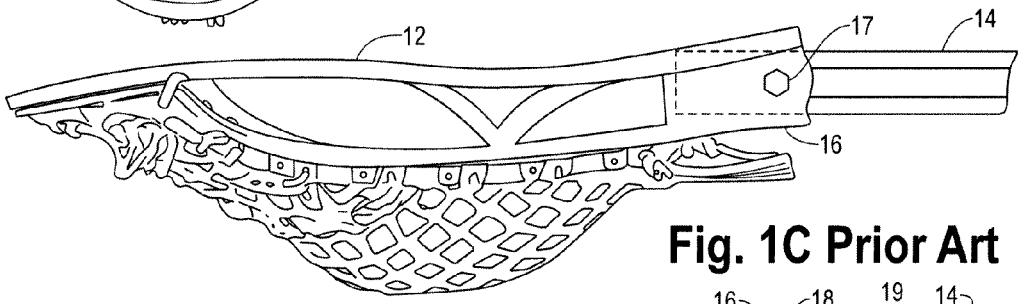
Fig. 1B Prior Art
FIG. 1B is a left side view of the lacrosse stick of FIG. 1.
Figure 1C:
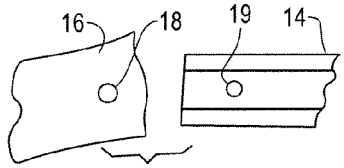
Fig. 1C Prior Art
FIG. 1C is a close up view of the portion of the lacrosse stick of FIG. 1 where the head and shaft are connected, shown disassembled.

Turning to the drawings, there is shown in FIGS. 1A, 1B and 1C a conventional lacrosse stick having two parts, a generally V-shaped head 12 and an elongated shaft or handle 14. The shaft 14 typically is a hollow tubular structure often made of a thin walled metal, while the head 12 includes an arcuate (curved) frame made of wood or plastic and having a narrow throat 16 extending rearward from the frame. A net is attached to the underside of the frame. The shaft 14 is inserted into a rearwardly facing socket or male connection in the throat 16, and is secured to the head 12 with a machine screw 17 or other fastener that is inserted into aligned mounting holes 18 and 19 located in the throat 16 and shaft 14, respectively. A disadvantage of conventional lacrosse sticks is that the shaft wall may be too thin to form a lasting connection with the head 12, which can lead to a loosening of the shaft 14 from the head 12.

Figure 2A:
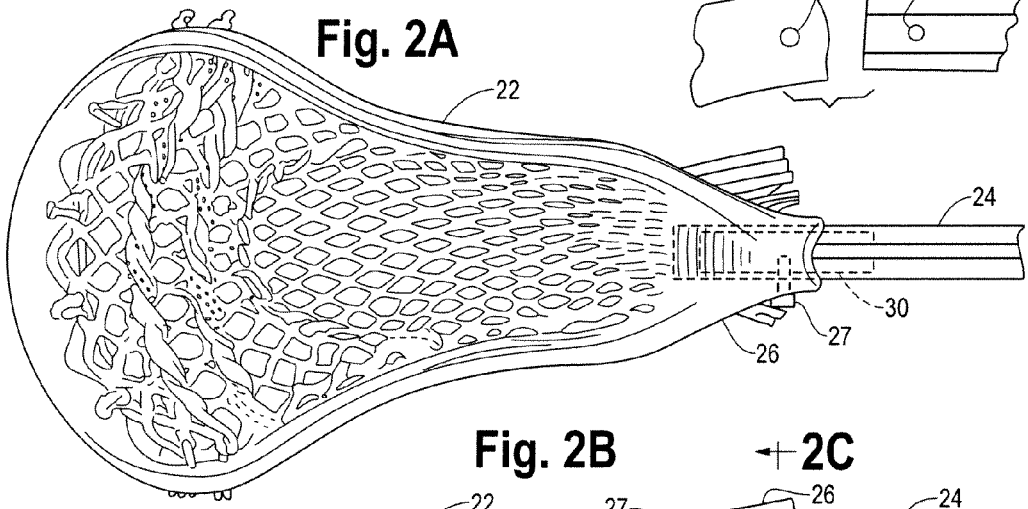
FIG. 2A is a top view a lacrosse stick according to the present invention.
Figure 2B:
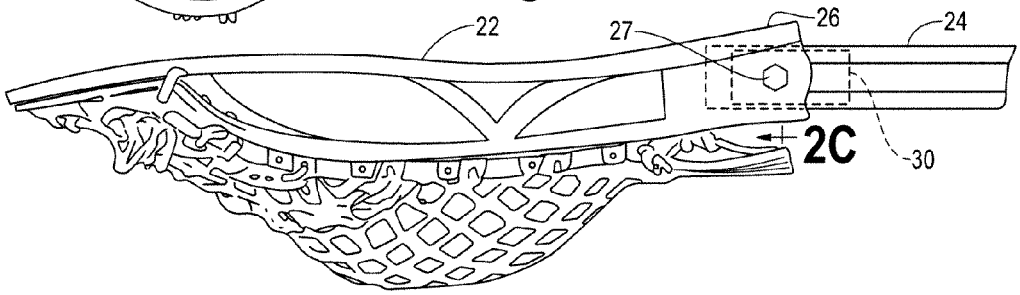
FIG. 2B is a side view of the lacrosse stick of FIG. 2A.

The present invention addresses this problem by providing a better means for attaching a lacrosse stick shaft to the head. Referring to FIGS. 2A and 2B, an improved lacrosse stick is provided that comprises a head 22 having a throat 26 with a mounting hole 28 defined therein, an elongated shaft 24 attached to the head 22, and a plug 30 disposed partly or entirely inside the hollow shaft 24 to reinforce the shaft/head connection as explained below.

Figure 3A:
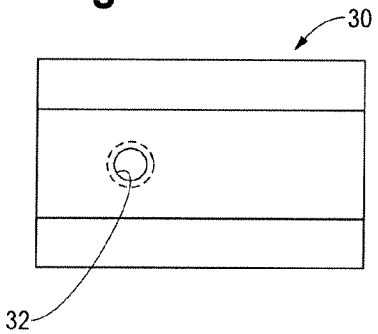
FIG. 3A is a left side view of an attachment plug according to the present invention.
Figure 3B:
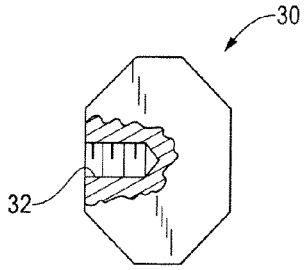
FIG. 3B is a front view of the attachment plug of FIG. 3A shown in partial cutaway view.
Figure 3C:
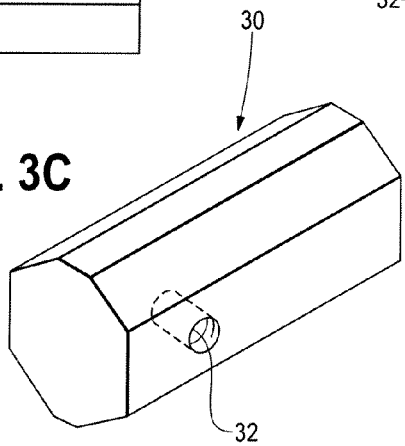
FIG. 3C is a perspective view of the attachment plug of FIG. 3A.

As shown in FIGS. 3A, 3B and 3C, the plug 30 has a pilot hole or threaded bore 32 located on a side of the plug 30. The bore 32 is located so that, when the plug is installed inside the shaft 24 and the shaft is inserted into the head 22, the bore 32 is aligned with the mounting holes on the shaft and head.

Figure 2C:
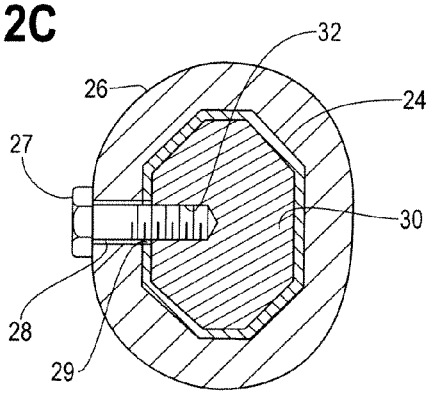
FIG. 2C is a cross-sectional view taken along line 2C-2C of FIG. 2B.

To attach the handle 24 to the head 22, the solid or almost solid plug 30 is first inserted into the hollow shaft 24 so that the plug 30 fits snugly but moveably inside the top end of the shaft 24 with the bore side of the plug 30 aligned with the side of the shaft 24 having a mounting hole 29. (Alternatively, the plug 30 can be inserted into the throat 26 of the head 22.) Next, the shaft 24 is inserted into the throat 26 of the head 22 so that the shaft mounting hole 29 aligns with the head mounting hole 28. The plug 30 should now be located so that the bore 32 aligns with both the shaft mounting hole 29 and head mounting hole 28. Next, a screw 27 is threaded through the mounting hole 28 so that it engages (in order) the head 22, the shaft 24 and the plug 30 as shown in FIG. 2C. Because the screw engages solid material along its entire length, the attachment of the head 22 to the shaft 24 remains secure, even during vigorous play. A common thread sealing compound disposed within the bore 32 may be used to enhance the attachment.

Magnetic Embodiments

It has been found that, once inserted into the shaft 24, the plug 30 sometimes falls to the bottom of the shaft 24, making alignment of the head 22, shaft 24 and plug 30 more difficult. For this reason a magnet or magnetic material may be integrated into the plug 30 and an external (handheld) magnet used to attract and lift the plug 30 into the required position for attachment.

Figure 4:
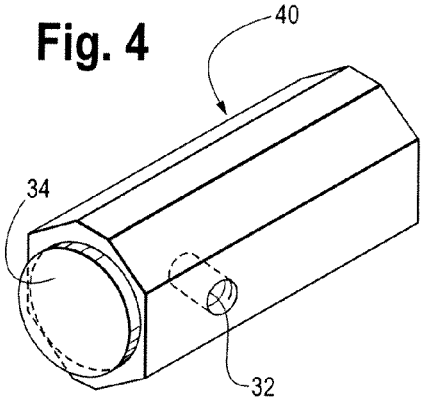
FIG. 4 is a perspective view of a second embodiment of the attachment plug according to the present invention.
Figure 5:
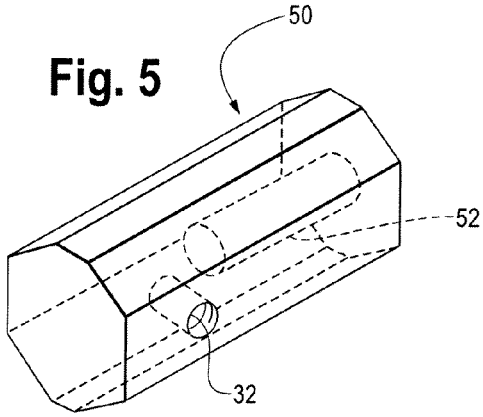
FIG. 5 is a perspective view of a third embodiment of the attachment plug according to the present invention.

FIGS. 4 and 5 illustrate two embodiments of the plug wherein a magnet or ferrous material is incorporated into the plug design. In FIG. 4 a flat, circular magnet 34 or ferrous material has been affixed to an end of the plug 40. As a practical matter, the magnet 34 should be near a side of the plug 40 so that the external magnet can be of manageable size. Preferably the diameter of the magnet 34 is close to the width of the plug 40 so the magnet 34 is near the wall of the shaft 24. In FIG. 5 a magnet 52 or ferrous material is incorporated into a hollowed out portion of the plug 50. A commonly available commercial magnet can easily lift the plug 40, 50 into alignment.

The magnetic plug 40, 50 has the added benefit that it can be run up and down the shaft 24 to see if the shaft 24 has bent during aggressive play. Any point where the shaft 24 is bent can be straightened, which will improve shooting accuracy.

Plug

The plug 30, 40, 50 is removable and reusable on other head and shaft combinations. Many players like to use a head from one manufacturer and a shaft from another. The guidable plug system allows this freedom. An added benefit is that head replacement can be done quickly during a game.

The dimensions of the plug 30, 40, 50 can be chosen for a particular manufacturer. The length of the plug is somewhat arbitrary, but 1.25 to 1.5 inches is recommended. In yet another embodiment the plug can be made with a rounded cross-section and the diameter chosen to fit into a multi-sided, usually octagonal shaft.

The plug can be made from any suitable material, including but not limited to wood, plastic and castable resin. DuPont's Delrin® has been shown to be an effective material. The wood and Delrin® materials are easily machined and all three accept the fastening screw very well. The castable resin does not need further machining.

For high volume production, the Delrin® or other similar material can be extruded to size once an extrusion die is made. The low cost will make this product available to all players, while allowing them the freedom to choose the head and shaft combinations they have on hand.

In some materials such as wood, the bore 32 can be replaced with a smaller pilot hole (not shown in the figures) that accepts a sheet metal screw 27.

Besides a sheet metal screw, any other suitable means of attachment may be used to attach the head to the shaft, including without limitation a machine screw, allen screw, bolt, hex head bolt, and nail, giving the end users flexibility in which tools they carry in their equipment bags.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

I claim as my invention:

1. A lacrosse stick with an improved head and shaft connection, the stick comprising:

a head having an arcuate frame and a narrow hollow throat extending rearward from the frame, the throat having an opening for receiving a shaft and a mounting hole located on a side of the throat;

a hollow tubular shaft configured to slide within the throat in telescoping fashion, the shaft having a sidewall and mounting hole disposed therein;

a separate plug having a body, the body having a length, a side, two opposing ends, and a cross-sectional shape substantially the same as the shaft, the body having a side and an opening disposed in the side, the plug being configured to be slidably received within the shaft and capable of sliding freely up and down inside the shaft, the plug further comprising a magnet; and attachment means;

wherein the plug can be inserted into the shaft and the shaft slid into the throat so that the head and shaft mounting holes and the plug opening are held in alignment for receiving the attachment means and wherein said attachment means is selected from the group consisting of a screw, bolt and nail.

2. The lacrosse stick of claim 1 wherein the magnet is affixed to an end of the plug.

3. The lacrosse stick of claim 1 wherein the magnet is disposed inside a hollowed out portion of the plug.

* * * * *